US010466637B2

(12) United States Patent
Deno

(10) Patent No.: US 10,466,637 B2
(45) Date of Patent: Nov. 5, 2019

(54) IMAGE FORMING APPARATUS

(71) Applicant: CANON KABUSHIKI KAISHA, Tokyo (JP)

(72) Inventor: Kohei Deno, Moriya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/230,089

(22) Filed: Dec. 21, 2018

(65) Prior Publication Data

US 2019/0121274 A1 Apr. 25, 2019

Related U.S. Application Data

(63) Continuation of application No. 15/425,116, filed on Feb. 6, 2017, now Pat. No. 10,197,961.

(30) Foreign Application Priority Data

Feb. 16, 2016 (JP) ..... 2016-027456
Dec. 16, 2016 (JP) ..... 2016-244304

(51) Int. Cl.
*G03G 15/00* (2006.01)
*G03G 15/16* (2006.01)
*G03G 15/23* (2006.01)

(52) U.S. Cl.
CPC ..... *G03G 15/5054* (2013.01); *G03G 15/161* (2013.01); *G03G 15/234* (2013.01); *G03G 15/6561* (2013.01); *G03G 2215/0129* (2013.01)

(58) Field of Classification Search
CPC ..... G03G 15/161; G03G 15/234; G03G 15/5054; G03G 15/6561; G03G 2215/0129
See application file for complete search history.

(56) References Cited

U.S. PATENT DOCUMENTS 5,666,629 A * 9/1997 Kazoh ..... B65H 15/00 271/186
6,386,080 B1 * 5/2002 Okamoto ..... B26D 5/32 83/289
8,348,266 B2 1/2013 Deno
8,408,830 B2 4/2013 Ogata et al.
8,494,433 B2 * 7/2013 Uchida ..... G03G 15/6567 399/388
8,540,240 B2 9/2013 Deno et al.
(Continued)

FOREIGN PATENT DOCUMENTS

JP 2009-143643 A 7/2009

*Primary Examiner* — Francis C Gray
(74) *Attorney, Agent, or Firm* — Venable LLP

(57) ABSTRACT

An image forming apparatus includes an image bearing member and an image forming portion configured to form first and second toner images on the image bearing member. A control portion controls the image forming portion such that a first toner image is formed on a first image position of the image bearing member, and a second toner image is formed on a second image position of the image bearing member. The sheet moves to a first sheet position corresponding to the first image position based on a first detection position before the first toner image is transferred onto a first surface of the sheet and moves, after being inverted, to a second sheet position corresponding to the second image position based on a second detection position before the second toner image is transferred onto a second surface of the sheet.

17 Claims, 12 Drawing Sheets

(56) References Cited

U.S. PATENT DOCUMENTS

| | | | | |
|---|---|---|---|---|
| 9,581,928 | B2 | 2/2017 | Deno | |
| 2009/0154975 | A1 | 6/2009 | Ogata et al. | |
| 2010/0278575 | A1* | 11/2010 | Mizuno | G03G 15/234 399/401 |
| 2012/0141179 | A1* | 6/2012 | Atsumi | G03G 15/6567 399/381 |
| 2012/0301198 | A1* | 11/2012 | Momiyama | G03G 15/234 399/361 |
| 2012/0313311 | A1* | 12/2012 | Kushida | B65H 31/3027 271/3.18 |
| 2013/0051884 | A1* | 2/2013 | Yamada | B65H 9/004 399/395 |
| 2013/0108283 | A1* | 5/2013 | Kawanago | G03G 15/0189 399/16 |
| 2015/0098741 | A1* | 4/2015 | Endo | G03G 15/235 399/364 |
| 2015/0338813 | A1* | 11/2015 | Deno | G03G 15/043 399/395 |
| 2017/0235254 | A1 | 8/2017 | Deno | |
| 2017/0235269 | A1 | 8/2017 | Deno | |
| 2018/0162667 | A1* | 6/2018 | Matsuda | B65H 9/20 |

* cited by examiner

FIG.8

| | | SUB-SCANNING LENGTH (mm) | | | |
|---|---|---|---|---|---|
| | | 148～297 | 298～432 | 433～488 | 489～900 |
| GRAMMAGE (gsm) | 52～150 | -0.8 | -0.8 | -0.8 | -1.0 |
| | 151～256 | -0.8 | -0.8 | -1.0 | -1.5 |
| | 257～350 | -1.0 | -1.2 | -1.5 | -2.0 |

IMAGE FORMING APPARATUS

This application is a continuation of application Ser. No. 15/425,116, filed Feb. 6, 2017.

BACKGROUND OF THE INVENTION

Field of the Invention

The present invention relates to an image forming apparatus configured to form an image on a sheet.

Description of the Related Art

Generally, in an image forming apparatus such as a copier, a sheet is sometimes laterally displaced in a width direction of the sheet while being conveyed. In the case where an image is formed on the sheet laterally displaced, the image printed on the sheet is displaced from the center of the sheet. This may be perceived as printing of a poor quality. Therefore, a shifting mechanism that detects the position of an edge portion of the sheet in the width direction and corrects the lateral displacement of the position of the sheet is known.

In Japanese Patent Laid-Open No. 2009-143643, an image forming apparatus that detects the position of an edge portion of a first page sheet in the width direction and corrects the image formation position for a third page sheet on a photoconductor on the basis of the amount of displacement of the edge portion of the first page sheet from a standard position is proposed. This image forming apparatus corrects the image formation position in advance on the basis of the amount of displacement of a sheet of two pages before, and thereby reduces the shift amount of the sheet to improve the image quality and the productivity of the image forming apparatus.

However, although the image forming apparatus disclosed in Japanese Patent Laid-Open No. 2009-143643 uses a detection result of an edge portion of a preceding sheet for determining the image formation position of a following sheet, the image forming apparatus does not change the image formation position between the first surface and the second surface of the sheet. Typically, the displacement of the position of an edge portion of a sheet in the width direction may occur during a duplex conveyance process of inverting and conveying the sheet for duplex printing, that is, after an image is formed on the first surface of the sheet and before the sheet reaches a registration roller pair again.

Thus, in the image forming apparatus disclosed in Japanese Patent Laid-Open No. 2009-143643, the shift amount for the second surface increases by an amount corresponding to the amount of displacement of the sheet in the width direction during the duplex printing process. This may lower the productivity and the image quality.

SUMMARY OF THE INVENTION

According to an aspect of the present invention, an image forming apparatus including an image bearing member, an image forming portion, a transfer portion, a moving portion, a re-conveyance portion, a detection portion, and a control portion is provided. The image forming portion is configured to form a toner image on the image bearing member. The transfer portion is configured to transfer the toner image formed on the image bearing member by the image forming portion onto a sheet having a first surface and a second surface. The moving portion is provided upstream of the transfer portion in a conveyance direction of the sheet and is configured to move the sheet in a width direction perpendicular to the conveyance direction. The re-conveyance portion is configured to invert the sheet bearing the toner image transferred onto the first surface such that the first surface and the second surface change places and convey the sheet to the transfer portion again. The detection portion is configured to detect a position of the sheet in the width direction. The control portion is configured to control the image forming portion such that the toner image to be transferred onto the first surface of the sheet is formed on a first image position of the image bearing member and a toner image to be transferred onto a second surface of the sheet is formed on a second image position of the image bearing member and control the moving portion based on a detection result of the detection portion such that the sheet being conveyed is moved to a position corresponding to the first image position or the second image position by the moving portion. A center of the toner image formed on the second image position in the width direction is displaced in the width direction from a center of the toner image formed on the first image position.

Further features of the present invention will become apparent from the following description of exemplary embodiments with reference to the attached drawings.

BRIEF DESCRIPTION OF THE DRAWINGS

FIG. 8 is a table for determining an offset value for a printer according to a second exemplary embodiment.

DESCRIPTION OF THE EMBODIMENTS

First Exemplary Embodiment

Figure 1:
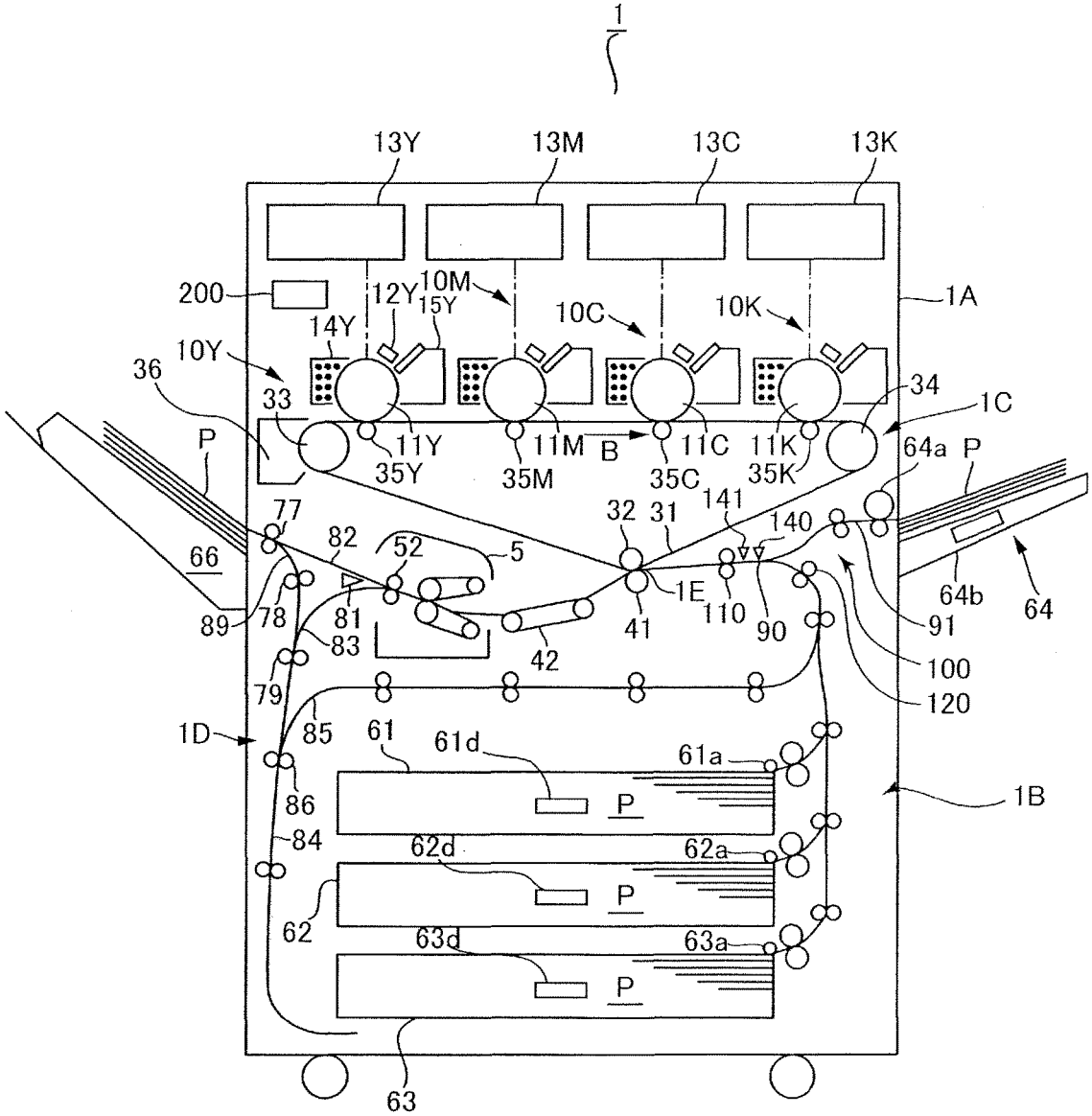
FIG. 1 is an overall schematic view of a printer according to a first exemplary embodiment.

First, a first exemplary embodiment of the present invention will be described. A printer 1 according to the first exemplary embodiment is an exemplary image forming apparatus and is a laser beam printer that employs an electrophotographic system. As illustrated in FIG. 1, the printer 1 includes a cassette sheet feed portion 1B, a manual sheet feed portion 64, a sheet conveyance unit 100, an image forming portion 1C, an intermediate transfer belt 31, a duplex conveyance portion 1D, and a control portion 200. The intermediate transfer belt 31 serves as an image bearing member, and the duplex conveyance portion 1D serves as a re-conveyance portion.

In the case where an instruction for image formation is input to the printer 1, the image forming portion 1C starts an image formation process on the basis of image information input from, for example, an external computer connected to the printer 1. The image forming portion 1C includes four exposing units 13Y, 13M, 13C, and 13K, and four process cartridges 10Y, 10M, 10C, and 10K that respectively form images of four colors of yellow, magenta, cyan, and black. The letters Y, M, C and K respectively correspond to yellow, magenta, cyan, and black. The four process cartridges 10Y, 10M, 10C, and 10K are the same in configuration except for the colors of images to be formed. Thus, only the image formation process of the process cartridge 10Y will be described and descriptions of process cartridges 10M, 10C, and 10K will be omitted.

The exposing unit 13Y emits laser light toward a photosensitive drum 11Y of the process cartridge 10Y on the basis of the input image information. At this time, the photosensitive drum 11Y has been electrified in advance by an electrifier 12Y, and an electrostatic latent image is formed on the photosensitive drum 11Y as a result of being irradiated with the laser light. Then, the electrostatic latent image is developed by a developing unit 14Y, and thereby a yellow toner image is formed on the photosensitive drum 11Y. After the toner image is transferred onto the intermediate transfer belt 31, toner remaining on the photosensitive drum 11Y is collected by a cleaner 15Y.

In a similar manner, toner images of magenta, cyan, and black are formed on respective photosensitive drums of process cartridges 10M, 10C, and 10K. The toner images of respective colors formed on the respective photosensitive drums are transferred onto the intermediate transfer belt 31 by primary transfer rollers 35Y, 35M, 35C, and 35K, and then conveyed to a secondary transfer inner roller 32 by the rotation of the intermediate transfer belt 31. The image formation processes of respective colors are performed at such timings that each toner image is transferred onto the intermediate transfer belt 31 so as to be superimposed on an upstream toner image that has been transferred through primary transfer. The intermediate transfer belt 31 is stretched over a driving roller 33, a tension roller 34, and the secondary transfer inner roller 32, and rotates in an arrow B direction.

In parallel with the image formation process described above, the cassette sheet feed portion 1B or the manual sheet feed portion 64 feeds a sheet P. The cassette sheet feed portion 1B includes a plurality of cassettes. In the present exemplary embodiment, the cassette sheet feed portion 1B includes three cassettes 61, 62, and 63, and pickup rollers 61*a*, 62*a*, and 63*a* each feed a sheet P from corresponding one of the cassettes 61, 62, and 63. The manual sheet feed portion 64 includes a manual feed tray 64*b* that is pivotably supported, and a sheet P supported on the manual feed tray 64*b* is fed by a pickup roller 64*a*.

The skew and the displacement in the width direction of the sheet P fed by the pickup roller 61*a*, 62*a*, 63*a*, or 64*a* are corrected by the sheet conveyance unit 100 that will be described later. The sheet P is subjected to a predetermined pressurizing force and electrostatic bias at a transfer nip 1E after having passed through the sheet conveyance unit 100, and a full-color toner image on the intermediate transfer belt 31 is thereby transferred onto a first surface of the sheet P. The transfer nip 1E is defined by the secondary transfer inner roller 32 and a secondary transfer outer roller 41 and serves as a transfer portion. Toner remaining on the intermediate transfer belt 31 is collected by a cleaner 36.

After the toner image is transferred onto the sheet P, the sheet P is conveyed to a fixing unit 5 by an air-attraction belt 42 and subjected to a predetermined pressurizing force and heat, and the toner image is thereby melted and fixed. After the sheet P passes through the fixing unit 5, the sheet P is conveyed, by a fixing conveyance roller pair 52, to a discharge conveyance path 82 in the case where the sheet P is to be directly discharged onto a discharge tray 66, and is conveyed to an inversion guidance path 83 in the case where images are to be formed on both surfaces of the sheet P or the like.

A guide member 81 is pivotably provided in a branch portion of the discharge conveyance path 82 and the inversion guidance path 83. The guide member 81 is provided for switching paths in accordance with switching between a discharge mode, an inversion discharge mode, and a re-conveyance mode. In the discharge mode, the sheet P is discharged onto the discharge tray 66. In the inversion discharge mode, the sheet P is discharged after being inverted. In the re-conveyance mode, the sheet P is conveyed to the image forming portion 1C again. The paths are switched by the guide member 81 in accordance with a set mode, and the sheet P is conveyed to the discharge conveyance path 82 or the inversion guidance path 83 according to the set mode.

For example, in the case where the discharge mode is set, the guide member 81 pivots downward and moves to a discharge position at which the guide member 81 guides the sheet P to be discharged. As a result of this, the sheet P conveyed by the fixing conveyance roller pair 52 is conveyed to the discharge conveyance path 82 along an upper surface of the guide member 81, and is discharged onto the discharge tray 66 by a discharge roller pair 77.

In the case where the re-conveyance mode is set, the guide member 81 pivots upward and moves to a drawing-in position at which the guide member 81 guides the sheet P to the inversion guidance path 83. As a result of this, the sheet P conveyed by the fixing conveyance roller pair 52 is guided to the inversion guidance path 83 along a lower surface of the guide member 81, and is drawn into a switchback path 84 by a first inversion roller pair 79. Then, the sheet P is inverted, by a switchback operation of reversing the rotation direction of a second inversion roller pair 86, such that the leading and trailing ends and surfaces of the sheet P change places, and is conveyed to a duplex conveyance path 85. After this, the sheet P conveyed to the duplex conveyance path 85 is conveyed to the transfer nip 1E through the sheet conveyance unit 100. The duplex conveyance portion 1D includes the inversion guidance path 83, the switchback path 84, the duplex conveyance path 85, the first inversion roller pair 79, the second inversion roller pair 86, and another conveyance roller pair. To be noted, the image formation process for a back surface to be performed after this is the same as the image formation process for front surface that has been already described. The front surface and the back surface respectively serve as a first surface and a second surface.

In the case where the inversion discharge mode is set, the guide member 81 pivots upward and moves to the drawing-in position. As a result of this, the sheet P is conveyed to the inversion guidance path 83 by the fixing conveyance roller pair 52, and is drawn into the switchback path 84 by the first inversion roller pair 79. Then, the sheet P is inverted, by a switchback operation of reversing the rotation direction of the first inversion roller pair 79, such that the leading and trailing ends of the sheet P change places, and is conveyed to the inversion conveyance path 89. After this, the sheet P is conveyed to the discharge roller pair 77 by an inversion conveyance roller pair 78 provided in the inversion conveyance path 89, and is discharged onto the discharge tray 66 by the discharge roller pair 77. The following description will be given on the premise that the printer 1 according to the present exemplary embodiment exemplarily employs a center-standard sheet conveyance system in which a sheet is conveyed such that the center of a sheet conveyance path in the width direction perpendicular to the sheet conveyance direction matches the center of the sheet in the width direction.

The cassettes 61, 62, and 63 are respectively provided with size detection mechanisms 61*d*, 62*d*, and 63*d* that each detect the size of a sheet P housed in the corresponding cassette. The size detection mechanisms 61*d*, 62*d*, and 63*d* are the same in configuration, and thus only the description of the size detection mechanism 61*d* provided for the cassette 61 will be given and the description of the other size detection mechanisms will be omitted.

The size detection mechanism 61*d* includes a side restriction plate and a size detection lever that are not illustrated. The side restriction plate restricts the position of the sheet P in the width direction. The size detection lever is pivotable, and is slidably in contact with and moves together with the side restriction plate. The side restriction plate is movable in accordance with a side edge portion of the sheet P. The size detection lever is configured to pivot in accordance with the movement of the side restriction plate in the case where the side restriction plate is moved in accordance with the side edge portion of the sheet P.

The size detection mechanism 61*d* includes plural sensors or switches that are capable of detecting the position of the size detection lever in a state where the cassette 61 is attached to a printer body 1A serving as an apparatus body. That is, in the case where the cassette 61 is attached to the printer body 1A, the size detection lever selectively turns detection elements of the sensors or switches on or off. As a result of this, the printer 1 receives a signal of a pattern varying depending on the sheet P housed in the cassette 61 output by the sensors or switches. The printer 1 is capable of recognizing the size or the like of the sheet P housed in the cassette 61 on the basis of the received signal.

The size detection mechanism 61*d* also detects attachment and detachment of the cassette 61. For example, in the case where the cassette 61 is detached, all of the detection elements of the sensors or switches are turned off due to the state of the size detection lever. In the present exemplary embodiment, a size detection mechanism 64*d* similar to the size detection mechanism 61*d* is also provided in the manual sheet feed portion 64.

The side restriction plate is provided for suppressing the skew and displacement in the width direction of the sheet P occurring at the time of feeding the sheet P and at conveyance rollers provided downstream of the pickup rollers. Practically, however, there may be a case where a little gap is present between the side restriction plate and the sheet P. This gap may cause the skew or the displacement in the width direction of the sheet P at the time of feeding or conveying the sheet P.

In this way, it is generally the case that, when setting a sheet P in the cassette 61, 62, or 63, the position of the center of the sheet P is displaced to the front or the back of the cassette 61, 62, or 63 due to the deterioration of the side restriction plate, vibration generated by insertion or drawing out of the cassette 61, 62, or 63, or the like. Moreover, there is a case where the dimensions of the sheet P are slightly different from the designed size. In this case, the sheet P remains offset by a certain constant value with respect to a standard position such as the center of the sheet conveyance path.

In an image forming apparatus according to a comparative embodiment that will be described later, control is performed such that the sheet P is shifted in the width direction by the same amount as the constant value described above. This means that the sheet P is shifted by a large amount. In addition, there is a case where the sheet P fed from a cassette is skewed while being conveyed, and is conveyed in a state of being skewed and also shifted in the width direction. To avoid such a state, skew correction or the like is performed by the sheet conveyance unit 100. This point will be described below in detail.

The sheet conveyance unit 100 is provided in a conveyance path 90 connecting the cassette sheet feed portion 1B, the manual sheet feed portion 64, and the transfer nip 1E. The sheet conveyance unit 100 includes a registration roller pair 110 serving as a moving portion, a preregistration roller pair 120, a registration sensor 140, and a contact image sensor: CIS 141 serving as a detection portion. The preregistration roller pair 120 is disposed upstream of the registration roller pair 110 in the sheet conveyance direction, and the registration sensor 140 and the CIS 141 are disposed between these roller pairs.

Figure 2:
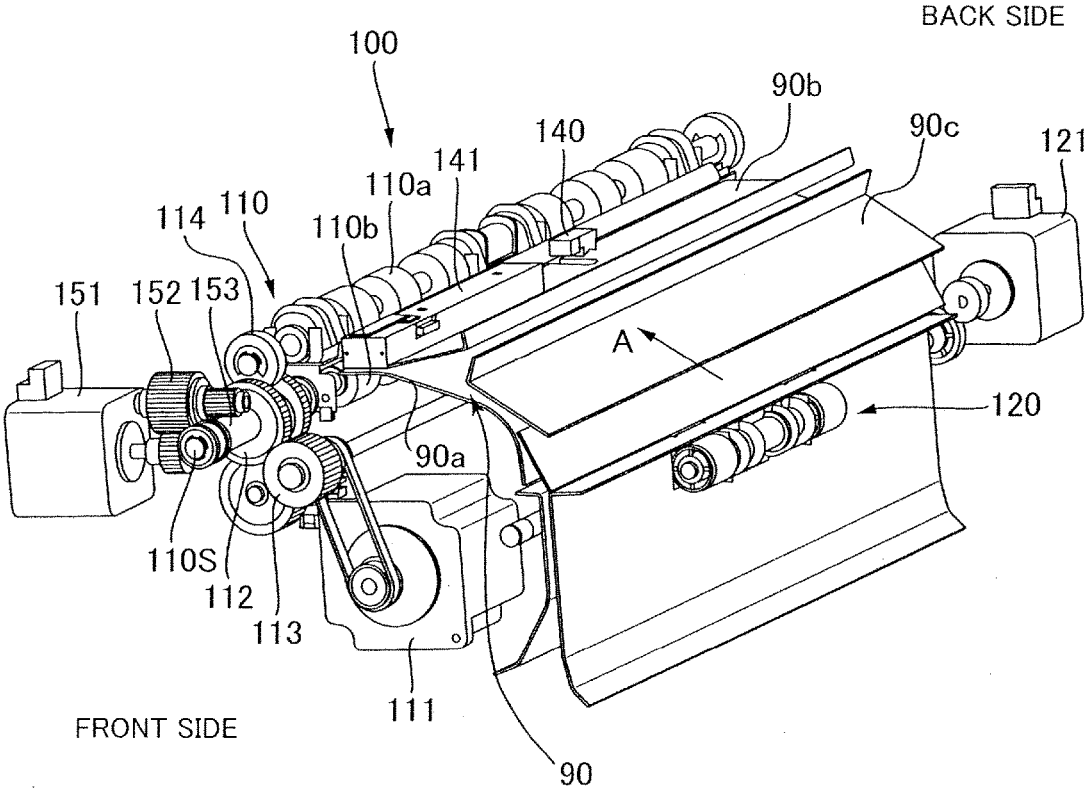
FIG. 2 is a perspective view of a sheet conveyance unit.

As illustrated in FIG. 2, the registration roller pair 110, which is a pair of rotatable members, include an upper roller 110*a* and a lower roller 110*b*. The lower roller 110*b* is fixed to a rotation shaft 110S. An input gear 112 is fixed to the rotation shaft 110S and is driven by a first driving motor 111 via an idler gear 113. The preregistration roller pair 120 is driven by a second driving motor 121.

The rotation shaft 110S supports a rack 153 such that the rack 153 is relatively rotatable with respect to the rotation shaft 110S and is not movable in the shaft direction. The rack 153 receives a driving force from a shift motor 151 via a pinion gear 152 and shifts the rotation shaft 110S in the shaft direction. The upper roller 110*a* is shifted in the shaft direction together with the lower roller 110*b* as a result of a flange portion 114 integrally provided with the upper roller 110*a* being nipped by the input gear 112 of the lower roller 110*b*. The position of the sheet P in the width direction is corrected as a result of the registration roller pair 110 nipping the sheet P moving in the width direction and thereby moving the sheet P in the width direction.

The face width of the idler gear 113 is larger than the face width of the input gear 112. The face widths are set such that the engagement of these gears are kept and thus the registration roller pair 110 remains rotatable even in the case where the registration roller pair 110 and the input gear 112 has' have moved in the width direction.

The CIS 141 detects the position of an edge portion of the conveyed sheet P in the width direction. The position of the edge portion will be hereinafter referred to as an edge position. The edge position of a sheet on a first surface of which a toner image is to be formed detected by the CIS 141 will be referred to as the edge position of the first surface, and the edge position of a sheet on a second surface of which a toner image is to be formed detected by the CIS 141 will be referred to as the edge position of the second surface. The control portion 200 calculates the amount of displacement between a designed standard position of the sheet, for example, a position at which the center of the conveyance path 90 and the center of the sheet match, and the edge position detected by the CIS 141, and causes the registration roller pair 110 to shift by the calculated amount of displacement in the case where an image is to be formed on the first surface of the sheet. As a result of this, the position of the sheet P in the width direction and the position of transfer at the image forming portion 1C match, and thereby a high-quality product can be obtained.

The CIS 141 is disposed at a position displaced from the center of the conveyance path 90 to one side in the width direction. This is because it suffices for position correction of the sheet P as long as the edge position of one edge portion of the sheet P is detected. In addition, the CIS 141 is capable of detecting the edge position of each of a sheet P having the smallest width and a sheet P having the largest width among sheets of sizes allowed to be used in the printer 1. The CIS 141 is disposed as close to the registration roller pair 110 as possible in order not to lower the detection precision of the CIS 141.

In the sheet conveyance unit 100, the leading end of the conveyed sheet P is caused to abut the nip portion of the registration roller pair 110 that is stopped such that the sheet P is warped, and thereby the leading end of the sheet P is aligned with the nip portion and the skew of the sheet P is corrected. The sheet P is advanced by a predetermined amount by the preregistration roller pair 120 after the registration sensor 140 detects the leading end of the sheet P, and then is conveyed to the transfer nip 1E by the registration roller pair 110. Further, the gap between the CIS 141 and a lower guide 90*a* opposing the CIS 141 is kept to a certain interval, and a predetermined space is defined in the conveyance path 90 by the lower guide 90*a* and upper guides 90*b* and 90*c* such that the sheet P is capable of warping.

Figure 3:
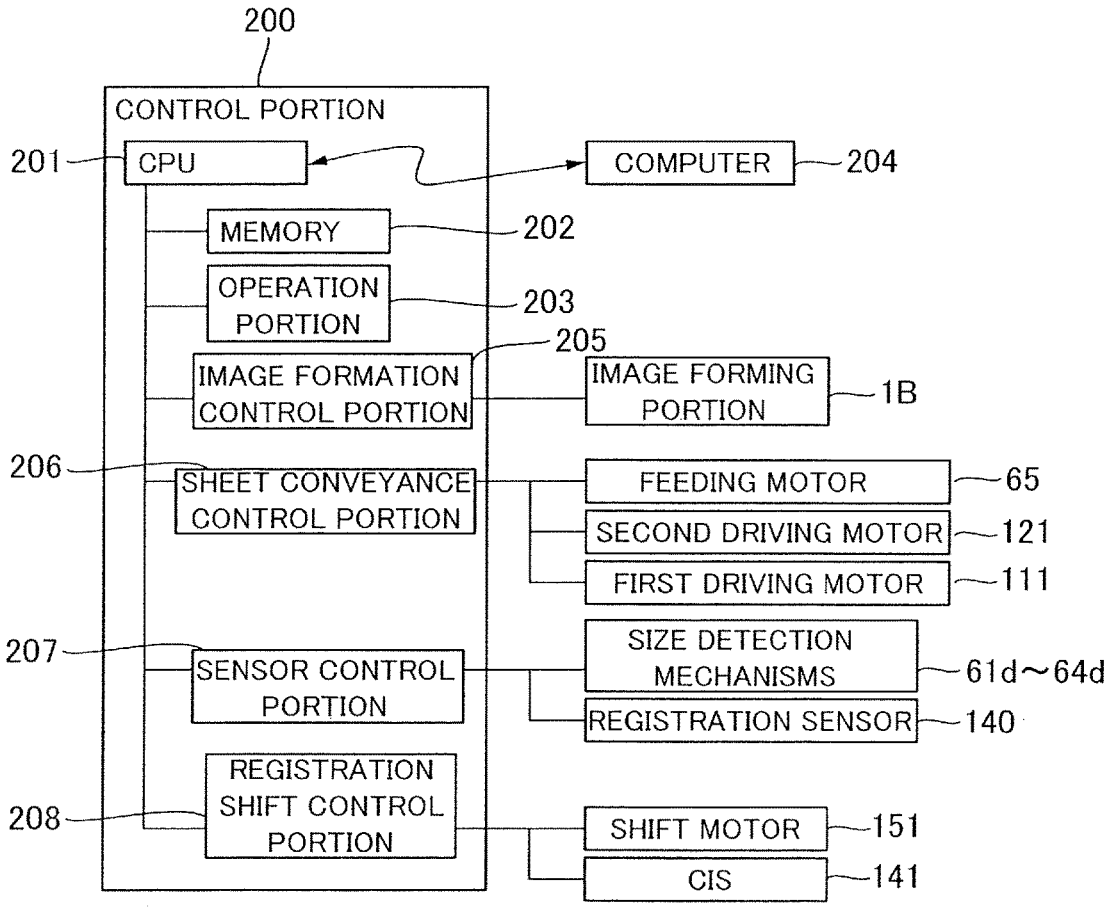
FIG. 3 is a block diagram of a control portion.

FIG. 3 is a control block diagram illustrating the control portion 200 of the printer 1. The control portion 200 includes a central processing unit: CPU 201, a memory 202, an operation portion 203, an image formation control portion 205, a sheet conveyance control portion 206, a sensor control portion 207, and a registration shift control portion 208. The CPU 201 realizes various processes performed by the printer 1 by executing a predetermined control program or the like. The memory 202 is constituted by, for example, a random access memory: RAM and a read only memory: ROM, and stores various programs and various data in a predetermined storage region. The operation portion 203 receives input of various information about sheets, execution and cancellation of jobs, and the like. Examples of the various information about sheets include sizes, grammages, and surface properties of sheets.

The image formation control portion 205 transmits an instruction to the image forming portion 1C including exposing units 13Y, 13M, 13C, 13K, and so forth and controls an image forming operation. The sheet conveyance control portion 206 transmits instructions to a feeding motor 65, the second driving motor 121, the first driving motor 111, and so forth and controls a conveyance operation of the sheet P. The feeding motor 65 drives the pickup rollers 61*a*, 62*a*, 63*a*, and the like. The sensor control portion 207 instructs the start and stop of detection performed by the sensors provided in the size detection mechanisms 61*d*, 62*d*, 63*d*, and 64*d*, the registration sensor 140, and the like, and receives detection results of these sensors.

The registration shift control portion 208 receives the detection result of the CIS 141, instructs the start and stop of driving of the shift motor 151 and the like, and controls a shifting operation of the registration roller pair 110 in the width direction. In addition, the CPU 201 is, for example, connectable to an external computer 204 via a network and capable of receiving various information about sheets, print jobs, and so forth from the computer 204.

Figure 4:
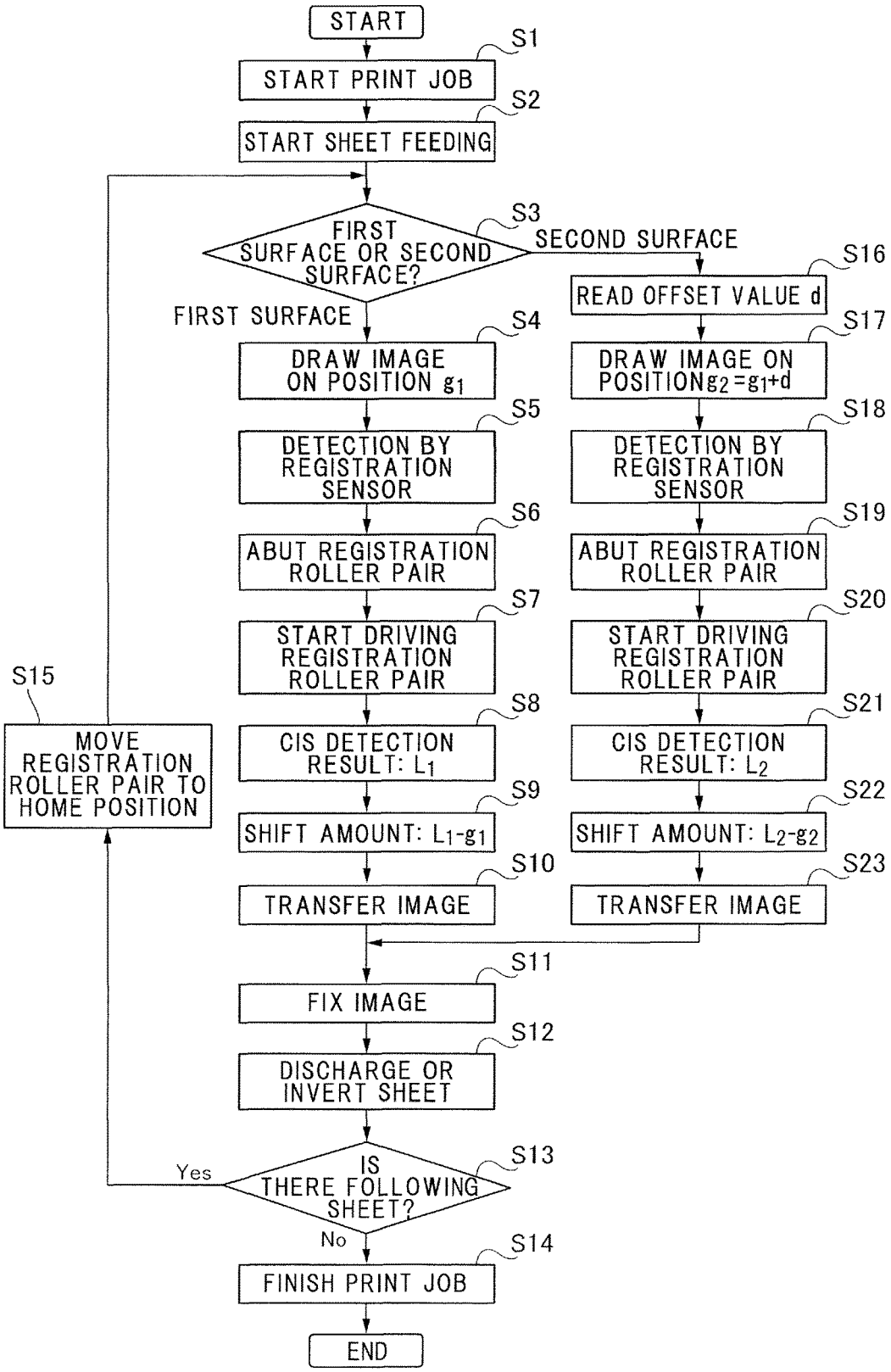
FIG. 4 is a flowchart illustrating a shifting process of a sheet.

Next, a shifting process of sheet P according to the present exemplary embodiment will be described with reference to a flowchart illustrated in FIG. 4. First, in step S1, a print instruction is input from the operation portion 203 or the computer 204, and the control portion 200 starts a print job. Via the operation portion 203 or the computer 204, a user is capable of instructing the number of copies to be printed and is also capable of designating a type of sheet to be used for the print. In addition, the control portion 200 receives sheet information of sheets housed in the cassettes 61, 62, and and supported on the manual feed tray 64*b* via the size detection mechanisms 61*d*, 62*d*, 63*d*, and 64*d*.

In step S2, the control portion 200 starts feeding a sheet P, and, in step S3, the control portion 200 determines which of printing on the first surface of the sheet P or printing on the second surface of the sheet P in the print job is to be performed. In the case where it is determined that the printing on the first surface of the sheet P is to be performed, the control portion 200 controls the image forming portion 1C to form a toner image on an image drawing position $g_1$ of the first surface serving as a first image position determined in advance for the intermediate transfer belt 31 in step S4. More specifically, the control portion 200 controls the exposing units 13Y, 13M, 13C, and 13K such that electrostatic latent images are formed on respective photosensitive drums of the process cartridges 10Y, 10M, 10C, and 10K at positions corresponding to the image drawing position $g_1$. Then, the electrostatic latent images formed on the respective photosensitive drums are developed as toner images by developing units, and these toner images are transferred onto the intermediate transfer belt 31 by the primary transfer rollers 35Y, 35M, 35C, and 35K. The image drawing position $g_1$ of the first surface is a value based on a result of adjustment performed, for example, at the time of shipping from a factory, and is stored in the memory 202 as a fixed value unique to the apparatus body.

Figure 5A:
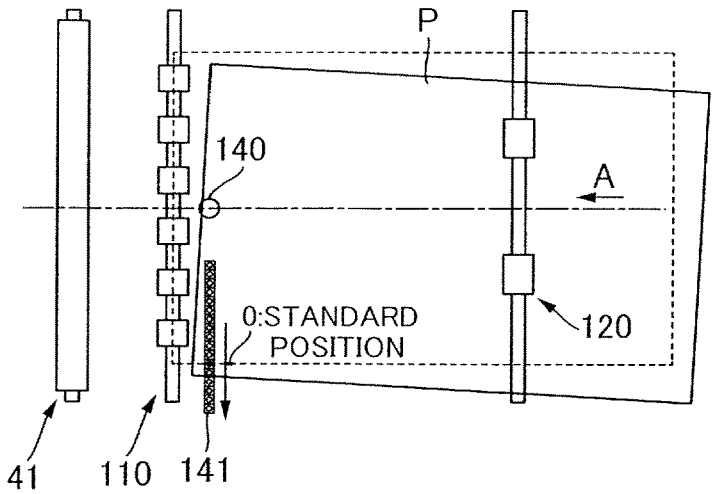
FIG. 5A is a plan view of a sheet in a skewed state.

Meanwhile, the sheet P is conveyed to the preregistration roller pair 120. Here, it is assumed that the conveyed sheet P is skewed as a result of rotating clockwise with respect to an arrow A direction, which is the conveyance direction, and is displaced to the left with respect to the arrow A direction as illustrated in FIG. 5A. To be noted, rectangles of dotted lines illustrated in FIGS. 5A to 6B schematically indicate a state in which the sheet P has been conveyed without being skewed or laterally displaced and the leading end of the sheet P is abutting the nip portion of the registration roller pair 110. The position of an edge portion of the sheet P in the width direction in this state is set as a zero point, and the direction to the left of the sheet P is set as a plus direction.

Figure 5B:
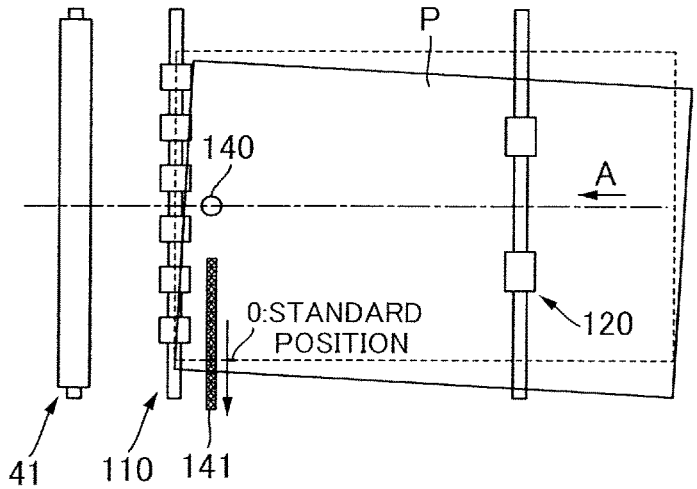
FIG. 5B is a plan view of the sheet whose skew is being corrected.
Figure 5C:
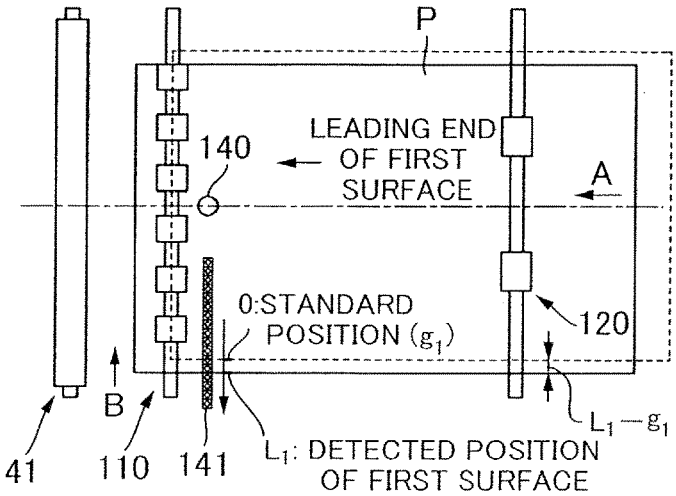
FIG. 5C is a plan view of the sheet being nipped by a registration roller pair.

Next, in step S5, the control portion 200 refers to the detection result of the registration sensor 140, and causes the preregistration roller pair 120 to advance the sheet P by a set advancing amount on the basis of the detection result. As a result of this, in step S6, the sheet P is caused to abut the registration roller pair 110 that is stopped, and a predetermined amount of warp is formed as illustrated in FIG. 5B. In this way, the skew of the sheet P is corrected, and, in step S7, the sheet P is nipped and conveyed by the registration roller pair 110 whose rotation has been started as illustrated in FIG. 5C.

After the skew of the sheet P is corrected, the CIS 141 detects the edge position of the sheet P in step S8, and the control portion 200 determines a shift mount of the sheet P on the basis of the detection result $L_1$. The shift amount is a distance of movement in the width direction of the sheet P. The shift amount of this case $L_1-g_1$ can be derived by subtracting the image drawing position $g_1$ from the detection result $L_1$ of the CIS 141. The detection result of the CIS 141 is stored in, for example, the memory 202.

Figure 6A:
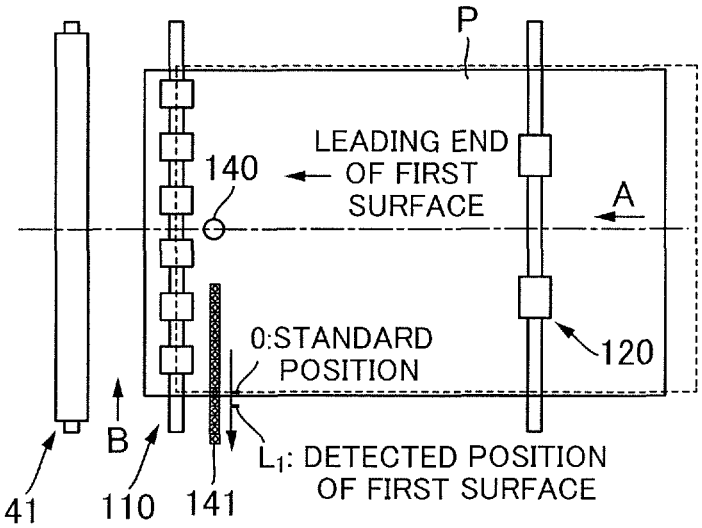
FIG. 6A is a plan view of the sheet whose lateral displacement of a first surface has been corrected.

In step S9, the control portion 200 controls the shift motor 151 to move the registration roller pair 110 nipping the sheet P in the width direction by the shift amount $L_1-g_1$. As a result of this, the lateral displacement is corrected in the first surface of the sheet P as illustrated in FIG. 6A. Then, in step S10, the toner image on the intermediate transfer belt 31 is transferred onto the sheet P that has been shifted by the shift amount $L_1-g_1$ by the registration roller pair 110 at the transfer nip 1E. In step S11, the toner image is melted and fixed by the fixing unit 5.

In the case where the print job is a single-sided printing job, the sheet P to which the toner image has been fixed is discharged onto the discharge tray 66 and the job is finished. However, in the case where the print job is a duplex printing job, an inversion process of the sheet P is performed for image formation on the second surface in step S12. Next, in step S13, the control portion 200 determines whether there is a following sheet. In the case where the control portion 200 determines that there is no following sheet, the print job is finished in step S14. In the case where the control portion 200 determines that there is a following sheet, the control portion 200 causes the registration roller pair 110 to move back to a home position in step S15. The home position is a center position in the present exemplary embodiment. Then, the process returns to step S3.

In the case where the control portion 200 determines that the printing on the second surface in the print job is to be performed in step S3, the duplex conveyance portion 1D conveys the sheet P to the preregistration roller pair 120 again. Since switchback conveyance of the sheet P in the duplex conveyance portion 1D is performed while nipping the sheet P only by the second inversion roller pair 86, there is a case where the sheet P is conveyed in a state of being skewed with respect to the conveyance direction. Particularly, the sheet P is more likely to be conveyed in a skewed state in the case where the second inversion roller pair 86 is misaligned or conveyance drag from a conveyance guide is large. Moreover, there is also a case where the sheet P is laterally displaced in the width direction while the sheet P is conveyed to the duplex conveyance path 85. Such lateral displacement occurring at the second inversion roller pair 86 or in the duplex conveyance path 85 is often determined by the mechanical configuration of the apparatus body, and, in the present exemplary embodiment, the amount of lateral displacement is stored in the memory 202 as an offset value d unique to the apparatus body.

The offset value d can be determined by an adjustment at the time of production. For example, an operator or a maintenance worker obtains the offset value d in the following adjustment mode. The case of the operator will be described below. The operator places an adjustment sheet in the cassette 61, 62, or 63 or on the manual feed tray 64*b*, and causes the adjustment sheet to be fed. Then, the operator calculates the offset value d from the difference between the position of the first surface of the adjustment sheet after the lateral displacement of the adjustment sheet is corrected by the sheet conveyance unit 100 and the edge position of the second surface of the adjustment sheet detected by the CIS 141. It is desirable that an adjustment sheet that is cut with a high cut precision is used. In the case where, for example, the cut precision is not high and the adjustment sheet does not have a rectangular shape, the offset value d includes the error of the cut.

The setting of the offset value d does not need to be kept at the same value after being determined at the time of production of the printer 1. For example, in some cases such as a case where a part of the duplex conveyance portion 1D is replaced, a case where the second inversion roller pair 86 is worn down, and a case where the environment in which the apparatus body is installed is changed, the offset value d needs to be adjusted again. Considering these cases, the operator can update the offset value d by adjusting the offset value d again by using the adjustment mode described above.

At the start of printing on the second surface of the sheet P, the control portion 200 reads the offset value d in step S16, and derives an image drawing position $g_2$ of the second surface serving as the second image position by adding the offset value d to the image drawing position g1 of the first surface. That is, $g_2=g_1+d$ holds. In step S17, the control portion 200 controls the image forming portion 1C to form a toner image on the image drawing position $g_2$ of the second surface. More specifically, the control portion 200 controls the exposing units 13Y, 13M, 13C, and 13K such that electrostatic latent images are formed on respective photosensitive drums of the process cartridges 10Y, 10M, 10C, and 10K at positions corresponding to the image drawing position $g_2$. Then, the electrostatic latent images formed on the respective photosensitive drums are developed as toner images, and these toner images are transferred onto the intermediate transfer belt 31 by the primary transfer rollers 35Y, 35M, 35C, and 35K. The operation of correcting the skew of the sheet P performed by the registration roller pair 110 for the second surface in steps S18 to S20 is the same as that for the first surface, and therefore the description thereof is omitted.

Figure 12:
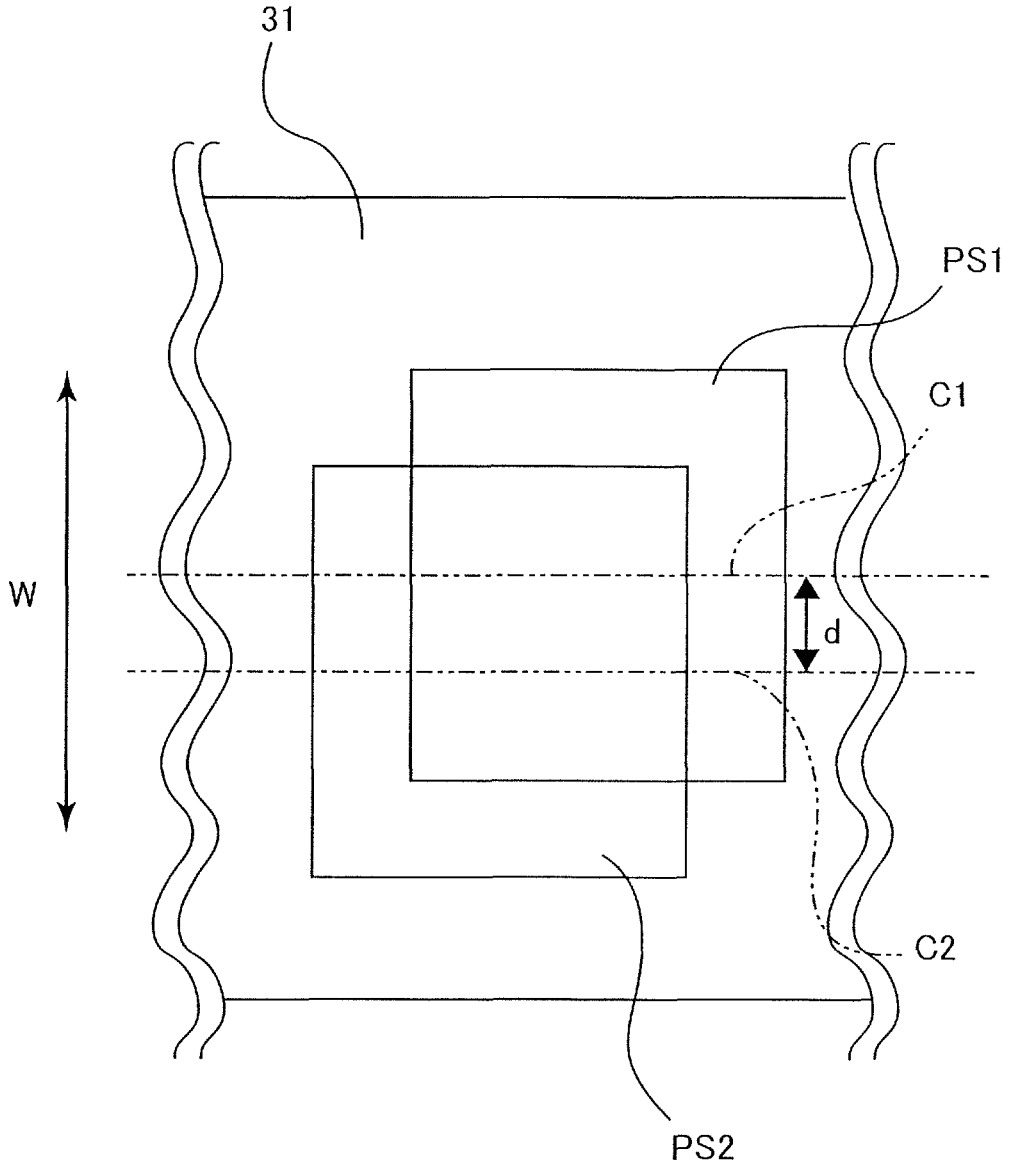
FIG. 12 is a schematic diagram illustrating a positional relationship between a toner image on a first surface and a toner image on a second surface.

FIG. 12 illustrates the positional relationship between a toner image PS1 of the first surface and a toner image PS2 of the second surface that are formed on the intermediate transfer belt 31. Practically, the toner image PS1 and the toner image PS2 will not be formed on the intermediate transfer belt 31 at the same time. However, the toner image PS1 and the toner image PS2 are both illustrated in FIG. 12 for description. The toner image PS1 is formed on the intermediate transfer belt 31 at the image drawing position $g_1$, and the toner image PS2 is formed on the intermediate transfer belt 31 at the image drawing position $g_2$. At this time, a center C2 of the toner image PS2 in a width direction W is displaced from a center C1 of the toner image PS1 in the width direction W by the offset value d in the width direction W.

Figure 6B:
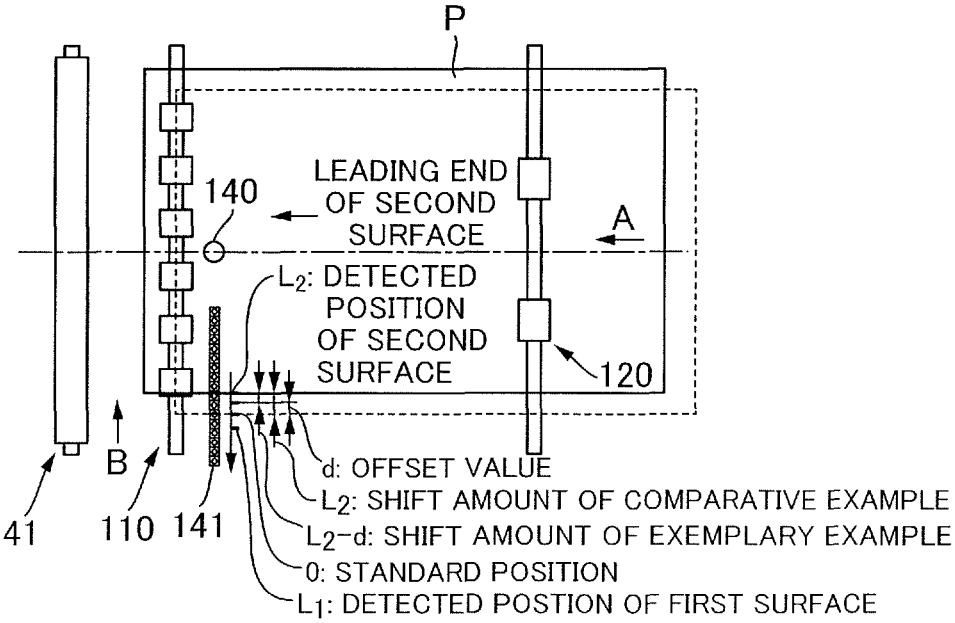
FIG. 6B is a plan view of the sheet whose lateral displacement of a second surface has been corrected.

Next, in step S21, after the skew is corrected, the CIS 141 detects the edge position of the second surface of the sheet P, and the control portion 200 determines the shift amount of the sheet P on the basis of the detection result $L_2$ as illustrated in FIG. 6B. This shift amount is derived by subtracting the image drawing position $g_2$ of the second surface from the detection result $L_2$ of the CIS 141.

In the example illustrated in FIG. 6B, an edge position of the sheet P corresponding to the image drawing position $g_1$ of the first surface is set as a standard position 0 for simplicity, that is, $g_1=0$ holds. In addition, there is a tendency that the sheet P is displaced to the back of the apparatus body during duplex conveyance by the duplex conveyance portion 1D, and the amount of this displacement is set as the offset value d. In this case, it is expected that the sheet P is displaced by about the offset value d after the sheet P is moved to the standard position 0 as a result of the correction of lateral displacement for the first surface described above and before the CIS 141 detects the edge position of the second surface. Since the image drawing position $g_2$ of the second surface is derived by adding the offset value d to the image drawing position $g_1$ of the first surface in the present exemplary embodiment, $g_2=g_1+d=d$ holds and the shift amount for the second surface is calculated as $L_2-g_2=L_2-d$ in step S22. That is, the image drawing position $g_2$ is displaced from the standard position 0 by the offset value d.

By contrast, in a comparative example in which the image drawing positions of the first surface and the second surface are set to be the same, the shift amount for the second surface is $L_2$, which is larger than the shift amount $L_2-d$ of the present exemplary embodiment, as illustrated in FIG. 6B. As described above, according to the present exemplary embodiment, the shift amount of the sheet P for the second surface can be reduced by taking the offset value d into consideration, and thereby the productivity of the printer 1 can be improved. In addition, the skew of the sheet P caused by a shifting operation can be reduced by reducing the amount of shift of the sheet P imparted by the registration roller pair 110. After finishing the correction of lateral displacement of the sheet P for the second surface, a toner image on the intermediate transfer belt 31 is transferred onto the sheet P at the transfer nip 1E in step S23. Steps subsequent to this step are the same as in the process for the first surface, and thus the description thereof is omitted.

Figure 7:
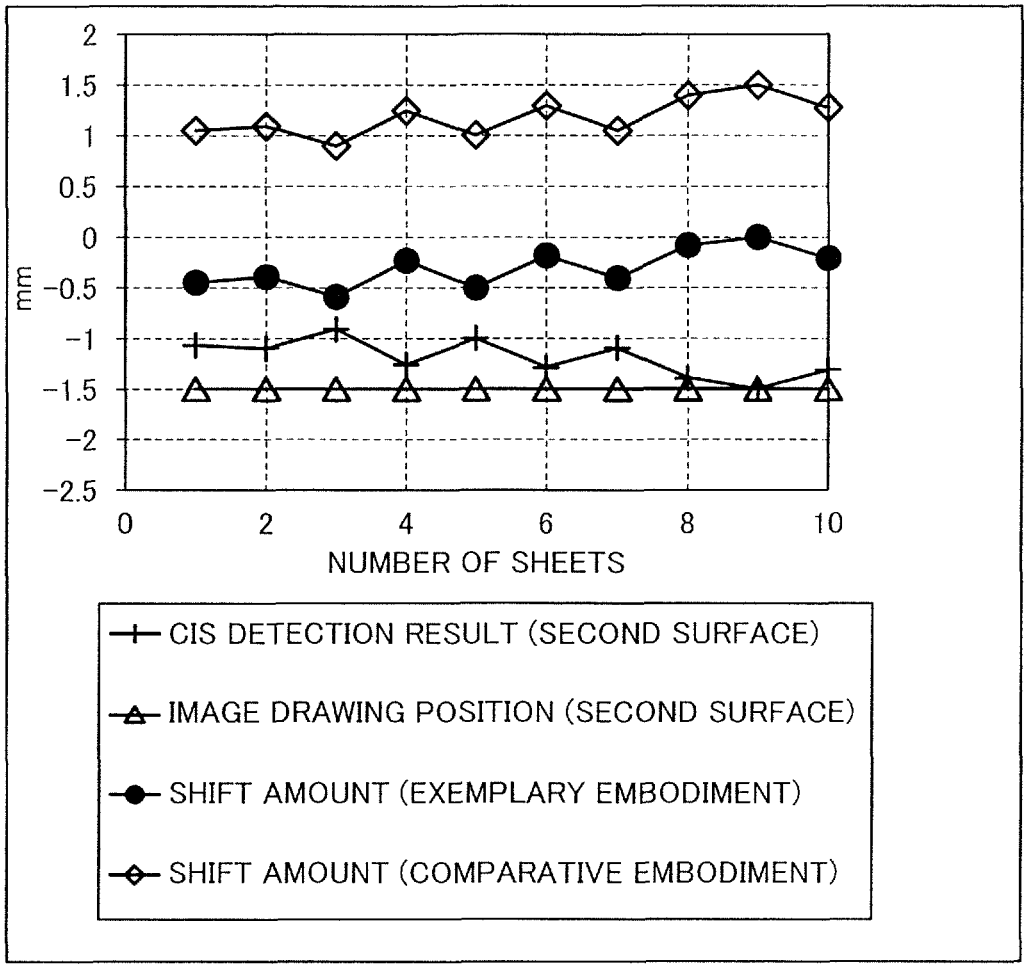
FIG. 7 is a graph illustrating shift amounts of the first exemplary embodiment and a comparative embodiment.

FIG. 7 is a graph in which detection results of the CIS 141, image drawing positions, and shift amounts for the second surface according to the present exemplary embodiment and the comparative embodiment in the case where ten sheets are consecutively fed in the printer 1 are respectively plotted. Here, the offset value d indicating the offset caused during duplex conveyance is set to d=1.5 mm. In addition, although nothing in particular is mentioned about the first surface here, it is assumed that the image drawing position $g_1$ of the first surface is set to the standard position 0, a shifting operation has been ideally performed in accordance with the detection result of the CIS 141 for the first surface, and the edge position of the sheet P immediately after the shifting operation is the standard position 0.

In the present exemplary embodiment, the detection results of the CIS 141 for the second surface are in the range of −1.1 mm to −1.6 mm. The absolute values of these values are close to the set offset value d=1.5 mm. Thus, according to the present exemplary embodiment, the shift amount of the sheet P can be reduced to the difference between the image drawing position $g_2$ of the second surface and the detection result of the CIS 141 for the second surface by setting the image drawing position $g_2$ of the second surface to −d, which is the difference from the image drawing position $g_1=0$ of the first surface. In the present exemplary embodiment, the shift amounts $L_2-d$ for the second surface are in the range of −0.4 mm to +0.1 mm. By contrast, in the comparative embodiment, it can be seen that the shift amounts are greatly raised to +1.1 mm to +1.6 mm because the image drawing positions of the first surface and the second surface are the same. As described above, according to the present exemplary embodiment, the amount of shift of a sheet impaired when forming an image on a second surface can be reduced, and thus the productivity of a printer can be improved and a high-quality product can be obtained. In addition, by reducing the shift amount, the skew of the sheet caused by a shift movement can be reduced.

Although the CIS 141 is disposed upstream of the registration roller pair 110 in the conveyance direction in the exemplary embodiment, the CIS 141 may be disposed downstream of the registration roller pair 110. In addition, a charge coupled device: CCD sensor or a complementary metal oxide semiconductor: CMOS sensor may be used in place of the CIS 141, and the position of an edge portion of the sheet in the width direction does not have to be detected if the position of the sheet in the width direction can be detected by such a sensor.

Further, a system of causing the sheet to abut a shutter member provided upstream of the registration roller pair 110 in the conveyance direction may be employed in place of the system of causing the sheet to abut the registration roller pair 110 to correct the skew thereof. In addition, another roller pair may be caused to shift the sheet in the width direction without causing the registration roller pair 110 that corrects the skew of the sheet to perform the shifting operation in the width direction.

Second Exemplary Embodiment

Next, a second exemplary embodiment of the present invention will be described. In the second exemplary embodiment, the offset value d described in the first exemplary embodiment is set as not a unique value but a variable that varies in accordance with the information about sheets. Thus, with regard to the same elements as the first exemplary embodiment, the illustration thereof will be omitted or the same reference letters will be given thereto in drawings for description.

There are various factors that change the offset value d of the same apparatus. In the present exemplary embodiment, for example, the offset value d is determined in accordance with the grammage and the length in the conveyance direction of the sheet P. The length of the sheet P in the conveyance direction will be hereinafter simply referred to as a sub-scanning length. Particularly, there is a case where the number of conveyance rollers provided in the printer 1 is set to be as small as possible from the viewpoint of the size and the costs of the apparatus body, and the switchback operation is often performed by one inversion roller pair. Generally, when the sheet P is nipped by one roller pair, the nip pressure is lower than when the sheet P is nipped by plural roller pairs, and thus the sheet P becomes more likely to be affected by a frictional drag received from a guide member while being conveyed. Particularly, in the case where the grammage of the sheet P is large and the stiffness of the sheet P is high, the sheet P is more likely to be skewed and thus the displacement of the edge position of the second surface of the sheet P becomes larger. Furthermore, the longer the distance in which the sheet P is conveyed by an inversion roller pair is, that is, the longer the sub-scanning length of the sheet P is, the amount of skew becomes larger. For example, it is found that the amount of skew becomes larger in the case where the inversion roller pair is misaligned.

In the present exemplary embodiment, considering such a tendency, a table of offset values d is stored in the memory 202 as illustrated in FIG. 8. This table is a two-dimensional table, and the offset value d is determined in accordance with the grammage and sub-scanning length of the sheet P. The offset values d are set in the range of −0.8 mm to −2.0 mm in accordance with combinations of the grammage and sub-scanning length of the sheet P.

The control portion 200 determines the offset value d in accordance with information of the grammage and sub-scanning length of the sheet P input from the operation portion 203 and the computer 204. The grammage and sub-scanning length of the sheet P may be detected by the size detection mechanisms 61*d* to 64*d*.

Although the offset value d is determined in accordance with the grammage and sub-scanning length of the sheet P, the embodiment is not limited to this. For example, the offset value d may be determined from a main-scanning length, a type, a surface property, or the like of the sheet P. The main-scanning length is the length of the sheet P in the width direction. In any of these cases, the offset value d is determined on the basis of the information about the sheet P.

Third Exemplary Embodiment

Next, a third exemplary embodiment of the present invention will be described. In the third exemplary embodiment, the offset value d is determined on the basis of the detection result of the CIS 141. Thus, with regard to the same elements as the first exemplary embodiment, the illustration thereof will be omitted or the same reference letters will be given thereto in drawings for description.

Figure 9:
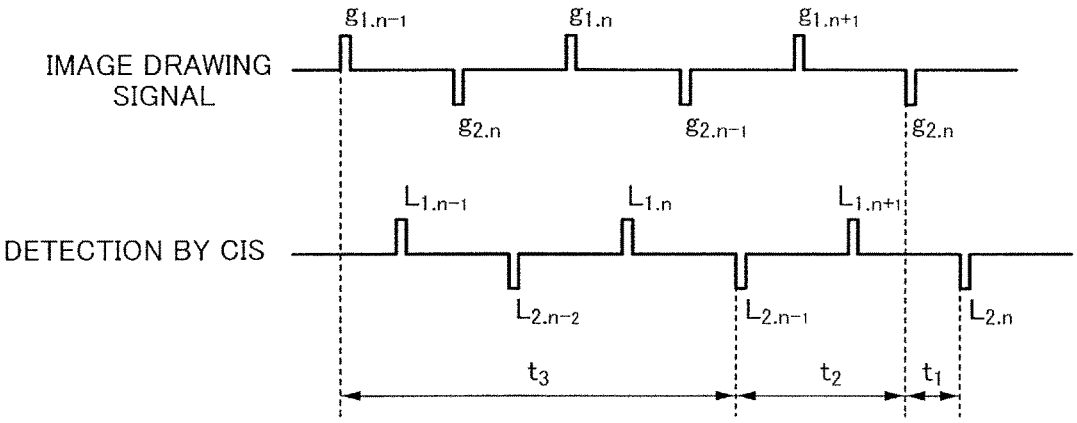
FIG. 9 is a timing chart of a printer according to a third exemplary embodiment.

FIG. 9 is a timing chart illustrating image drawing timing and CIS detection timing for three sheets while image formation is consecutively performed. For example, a $g_{1,n-1}$ indicates an image drawing signal for the first surface of an (n−1)-th sheet, and $L_{2,n}$ indicates a CIS detection signal for the second surface of an n-th sheet.

Referring to the timing chart illustrated in FIG. 9, the image drawing on the second surface of the n-th sheet is performed at a time earlier by time $t_1$ than the time at which the edge position of the second surface of the sheet is detected by the CIS 141. Therefore, the offset value d cannot be determined on the basis of the detection result of the n-th sheet itself.

Thus, in the present exemplary embodiment, the offset value d influential to the image forming position on the second surface of the n-th sheet is set on the basis of the edge position of the second surface of the preceding (n−1)-th sheet. Here, the n-th sheet is the second sheet and the (n−1)-th sheet is the first sheet. More specifically, the detection of the edge position of the second surface of the (n−1)-th sheet by the CIS 141 is performed at a time earlier by time $t_2$ than the image drawing timing on the second surface of the n-th sheet. The image drawing timing on the first surface of the (n−1)-th sheet is earlier by time $t_3$ than a time at which the edge position of the second surface of the (n−1)-th sheet is detected by the CIS 141. Therefore, the offset value d can be updated on the basis of the amount of lateral displacement of the (n−1)-th sheet occurring during duplex conveyance, and the update can be reflected on the image drawing on the second surface of the n-th sheet. The amount of lateral displacement of the (n−1)-th sheet occurring during duplex conveyance can be derived by subtracting the edge position of the second surface of the (n−1)-th sheet from the edge position of the first surface of the (n−1)-th sheet.

In addition to the case where the cause of the lateral displacement of the sheet lies in a phenomenon unique to the apparatus body, a case where the cause of the lateral displacement lies in the sheet can be assumed. For example, it has been already known that the position of the second surface relative to the first surface is displaced in the width direction in the case where the sheet is not cut in a perfect right angle. The printer 1 of the present exemplary embodiment can sequentially update the offset value d during a consecutive printing job. Therefore, even in the case where properties of the sheet P such as perpendicularity change between sheets, the amount of displacement in the second surface can be estimated more precisely. This can reduce the shift amount of the registration roller pair 110, and thereby the productivity of the printer 1 can be improved and a high-quality product can be obtained.

The offset value d may be updated using the CIS detection result of the (n−2)-th sheet in addition to that of the (n−1)-th sheet as long as the update is not late for the image drawing timing on the second surface of the n-th sheet. In addition, the offset value d may be updated using a value obtained by multiplying the amount of displacement of the (n−1)-th sheet in the width direction by a weight $\alpha$ in order to reduce the influence of a sudden lateral displacement of the sheet. For example, the weight $\alpha$ is set to $\alpha=0.7$. In addition, the offset value d may be calculated not by using only the CIS detection result of the (n−1)-th sheet but from the average of CIS detection results of plural preceding sheets.

The detection of edge position of the sheet may be performed by the CIS 141 before or after finishing the shifting operation of the sheet. Therefore, the CIS 141 may be disposed upstream or downstream of the registration roller pair 110 in the conveyance direction.

Fourth Exemplary Embodiment

Next, a fourth exemplary embodiment of the present invention will be described. The fourth exemplary embodiment includes three modes of determining the offset value d after switching a cassette to be used. With regard to the same elements as the first exemplary embodiment, the illustration thereof will be omitted or the same reference letters will be given thereto in drawings for description.

The appropriate value of the offset value d varies depending on the length of the conveyance path, the length of the sheet, and the like. Therefore, an exemplary case where the cassette to be used is switched from the cassette 61 at the top tier serving as a first sheet supporting portion to the cassette 63 at the bottom tier serving as a second sheet supporting portion is assumed. In the case where the offset value used for the cassette 61 is applied to the cassette 63, the shift amount of the sheet may not be appropriately reduced. In addition, the cassettes 61, 62, and 63 are attachable to and detachable from the printer body TA, and whether the same offset value should be used varies even for the same cassette depending on whether the cassettes 61, 62, and 63 are detached and reattached. This is because there is a possibility that the sheet in the cassette is replenished or replaced in the case where the cassette is detached and reattached. A case where a same cassette is detached and reattached will be described below. To be noted, the same control is performed in the case where the cassette to be used is switched to another cassette.

Therefore, in the present exemplary embodiment, the following three modes are settable as initial setting modes of the printer 1. The first mode is a high productivity mode in which the offset value d of the sheet is never updated regardless of whether the cassette is detached and reattached. The second mode is a high precision mode in which the offset value d of the sheet is always kept updated regardless of whether the cassette is detached and reattached. The third mode is an automatic mode in which whether the offset value d of the first sheet after the cassette is reattached is to be updated is determined in accordance with whether the cassette is detached and reattached. These initial settings are set by using the operation portion 203.

Figure 10:
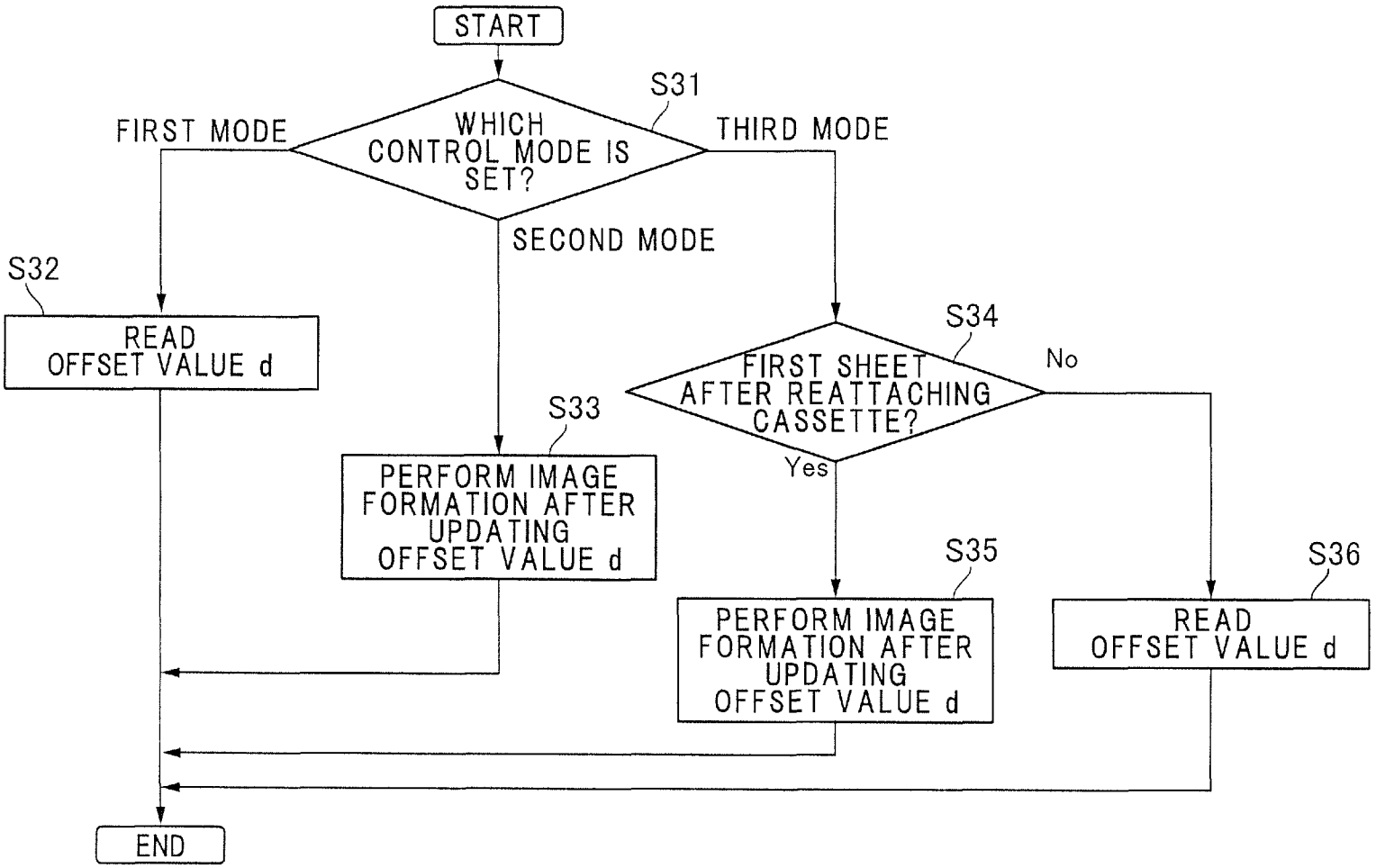
FIG. 10 is a flowchart illustrating control for determining an offset value for a printer according to a fourth exemplary embodiment.

FIG. 10 is a flowchart for describing control for these three modes. First, in step S31, the control portion 200 determines which of the first mode, second mode, and third mode is selected as a control mode when the cassette to be used is switched. In the case where the first mode is set as the control mode, the control portion 200 does not update the offset value d regardless of the detaching and reattaching of the cassette. Then, in step S32, the control portion 200 determines the image drawing position of the second surface of the first sheet by using the offset value d that is either one of a value unique to the apparatus body and a value determined in a past print job using the same cassette. That is, the image drawing is not delayed waiting for the update of the offset value d in the image drawing on the second surface of the first sheet. This leads to a high productivity.

In the case where the second mode is set in step S31, the control portion 200 updates the offset value d regardless of the detaching and reattaching of the cassette. More specifically, in step S33, the control portion 200 determines the offset value d for the image drawing position of the first surface by causing the CIS 141 to detect the edge portion of the first surface and the second surface of the first sheet. After determining the offset value d, an image for the second surface of the first sheet is drawn on each photosensitive drum on the basis of the offset value d. In the second mode, since the image for the second surface requires to be formed in the image forming portion 1C after the offset value d is determined, the image for the second surface cannot be drawn on each photosensitive drum before the detection of the edge position of the second surface by the CIS 141 is finished. Therefore, in the second mode, while a highly-precise printing can be performed, the productivity of the printer 1 decreases. By contrast, in the first mode, while a high productivity is achieved, the shift amount increases and thus the precision related to the skew or the like slightly decreases.

In the case where the third mode is set in step S31, the control portion 200 determines, in step S34, whether the cassette is detached and reattached and sheet feeding for this time is the first sheet feeding after the reattaching of the cassette to which the cassette to be used has been switched. Then, in the case where the cassette is detached and reattached and the sheet feeding for this time is the first sheet feeding after the reattaching of the cassette, the control portion 200 updates the offset value d of the first sheet and determines the image drawing position $g_2$ of the second surface of the first sheet on the basis of the result of the update in step S35. In the case where it is determined that the sheet feeding of this time is not the first sheet feeding after the reattaching of the cassette in step S34, the control portion 200 does not update the offset value d of the first sheet and uses, in step S36, the offset value determined in the previous print job using the same cassette. Then, the control portion 200 causes the image forming portion 1C to form the image for the second surface before the detection of the edge position of the second surface by the CIS 141 is finished. That is, in the third mode, whether the offset value d is to be updated is automatically determined in accordance with whether the cassette is detached and reattached. According to this, a mode switching operation by a user is not required, and printing with a high productivity and a high precision can be performed.

As described above, in the present exemplary embodiment, inclusion of the three control modes allows setting, in detail, to which of the productivity and the high precision importance should be given in the control. Therefore, the usability can be improved.

Fifth Exemplary Embodiment

Next, a fifth exemplary embodiment of the present invention will be described. The fifth exemplary embodiment is configured such that the shifting operation is invalidated in the adjustment mode described in the first exemplary embodiment. With regard to the same elements as the first exemplary embodiment, the illustration thereof will be omitted or the same reference letters will be given thereto in drawings for description.

Figure 11:
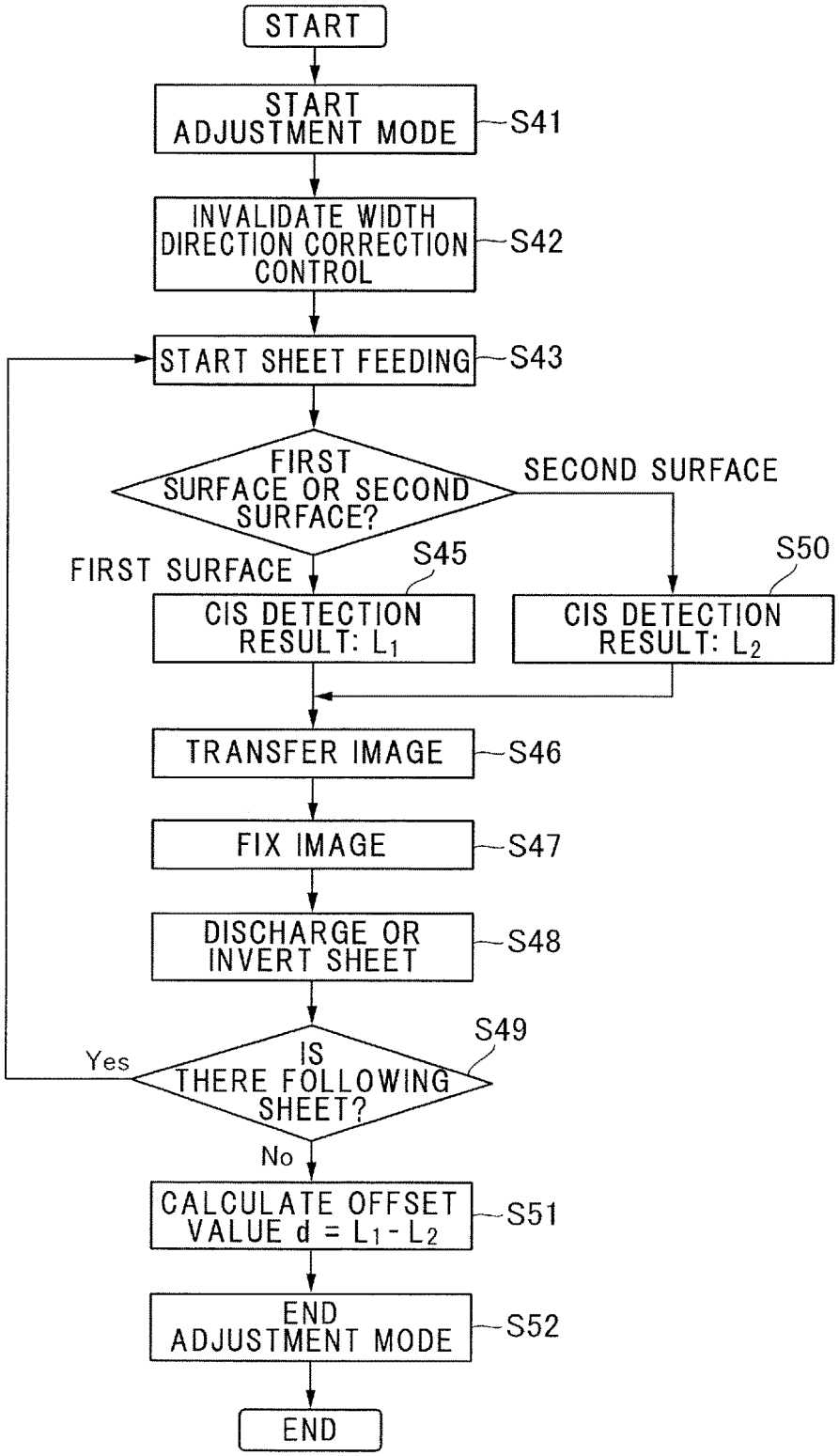
FIG. 11 is a flowchart illustrating a process in an adjustment mode according to a fifth exemplary embodiment.

FIG. 11 is a flowchart illustrating a procedure for obtaining the offset value d in the printer 1. First, the control portion 200 starts the adjustment mode in step S41, and invalidates the shifting operation by the sheet conveyance unit 100 in step S42 as illustrated in FIG. 11. Then, the control portion 200 starts feeding the sheet in step S43, and, after this, determines for which of the first surface and the second surface of the sheet the image formation of this time in the print job is in step S44. In the case where it is determined that the image formation of this time is for the first surface in step S44, the CIS 141 detects the edge position of the first surface of the sheet, and the control portion 200 obtains the detection result $L_2$.

Then, in step S46, a toner image is transferred onto the sheet at the transfer nip 1E, and, in step S47, the toner image is melted and fixed by the fixing unit 5. In the case where the print job is a single-sided printing job, the sheet to which the toner image has been fixed is discharged onto the discharge tray 66 and the job is completed. However, in the case where the print job is a duplex printing job, an inversion process of the sheet P is performed for image formation on the second surface in step S48. Next, in step S49, the control portion 200 determines whether there is a following sheet.

After this, in the case where it is determined that the image formation of this time is for the second surface in step S44, the CIS 141 detects the edge position of the second surface of the sheet, and the control portion 200 obtains the detection result $L_2$. Then, the process proceeds to step S49 similarly to the control for the first surface, and, in the case where it is determined that there is no following sheet, the control portion 200 calculates the offset value d by subtracting the detection result $L_2$ from the detection result $L_1$ in step S51, that is, $d=L_1-L_2$ holds. After the steps above, the adjustment mode is finished in step S52.

As described above, in the present exemplary embodiment, the offset value d is obtained with the shifting operation by the sheet conveyance unit 100 invalidated. This is because there is a possibility that the skew of the sheet occurs due to the shifting operation for the first surface, and a precise offset value d cannot be obtained when the sheet is skewed. Thus, according to the present exemplary embodiment, a highly-precise offset value d can be obtained, and the shift amount can be further reduced.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-027456, filed Feb. 16, 2016, and Japanese Patent Application No. 2016-244304, filed Dec. 16, 2016, which are hereby incorporated by reference herein in their entirety.

What is claimed is:

1. An image forming apparatus comprising:

an image bearing member;

an image forming portion configured to form first and second toner images on the image bearing member;

a transfer portion configured to transfer the first and second toner images formed on the image bearing member by the image forming portion onto a sheet having a first surface and a second surface;

a moving portion provided upstream of the transfer portion in a conveyance direction of the sheet and configured to move the sheet in a width direction perpendicular to the conveyance direction;

a re-conveyance portion configured to invert the sheet bearing the first toner image transferred onto the first surface such that the first surface and the second surface change places and convey the sheet to the transfer portion again;

a detection portion configured to detect a first detection position where a position, in the width direction, of the sheet before the first toner image is transferred onto the first surface, and a second detection position where a position, in the width direction, of the sheet inverted by the re-conveyance portion before the second toner image is transferred onto the second surface; and a control portion configured to control the image forming portion such that the first toner image to be transferred onto the first surface of the sheet is formed on a first image position of the image bearing member and the second toner image to be transferred onto the second surface of the sheet is formed on a second image position of the image bearing member, the first image position and the second image position being displaced in the width direction, wherein the control portion controls the moving portion so as to move the sheet in the width direction to a first sheet position corresponding to the first image position based on the first detection position detected by the detection portion before the first toner image is transferred onto the first surface of the sheet, and to move the sheet in the width direction, which has been moved by the moving portion to the first sheet position and inverted by the re-conveyance portion, to a second sheet position corresponding to the second image position based on the second detection position detected by the detection portion before the second toner image is transferred onto the second surface of the sheet.

2. The image forming apparatus according to claim 1, wherein the second image position is displaced from the first image position by an offset value.

3. The image forming apparatus according to claim 2, wherein the offset value is a fixed value set in advance.

4. The image forming apparatus according to claim 2, wherein the offset value is set based on information about the sheet.

5. The image forming apparatus according to claim 2, wherein the offset value is set based on a length of the sheet in the conveyance direction.

6. The image forming apparatus according to claim 2, wherein the offset value is set based on a grammage of the sheet.

7. The image forming apparatus according to claim 2, wherein the control portion is configured to execute an adjustment mode in which the offset value is capable of being updated based on the first and second detection positions detected by the detection portion.

8. The image forming apparatus according to claim 7, wherein in the adjustment mode, the control portion does not cause the moving portion to move in the width direction before the sheet is inverted by the re-conveyance portion.

9. The image forming apparatus according to claim 1, wherein the detection portion is disposed upstream of the moving portion in the conveyance direction.

10. The image forming apparatus according to claim 1, wherein the moving portion comprises a pair of rotatable members configured to correct a skew of a sheet whose leading end abuts the pair of rotatable members.

11. An image forming apparatus comprising:

an image bearing member;

an image forming portion configured to form first and second toner images on the image bearing member;

a transfer portion configured to transfer the first and second toner images formed on the image bearing member by the image forming portion onto a sheet having a first surface and a second surface;

a moving portion provided upstream of the transfer portion in a conveyance direction of the sheet and configured to move the sheet in a width direction perpendicular to the conveyance direction;

a re-conveyance portion configured to invert the sheet bearing the first toner image transferred onto the first surface such that the first surface and the second surface change places and convey the sheet to the transfer portion again;

a detection portion configured to detect a first detection position where a position, in the width direction, of the sheet before the first toner image is transferred onto the first surface, and a second detection position where a position, in the width direction, of the sheet inverted by the re-conveyance portion before the second toner image is transferred onto the second surface; and a control portion configured to control the moving portion so as to move the sheet in the width direction to a first sheet position based on the first detection position detected by the detection portion before the first toner image is transferred onto the first surface of the sheet, and to move the sheet, which has been moved by the moving portion to the first sheet position and inverted by the re-conveyance portion, in the width direction to a second sheet position displaced from the first sheet position by an offset value in the width direction based on the second detection position detected by the detection portion before the second toner image is transferred onto the second surface of the sheet, wherein the control portion configured to control the image forming portion such that the first toner image is formed on a position, of the image bearing member, corresponding to the first sheet position and that the second toner image is formed on a position, of the image bearing member, corresponding to the second sheet position.

12. The image forming apparatus according to claim 11, wherein the offset value is a fixed value set in advance.

13. The image forming apparatus according to claim 11, wherein the offset value is set based on information about the sheet.

14. The image forming apparatus according to claim 11, wherein the offset value is set based on a length of the sheet in the conveyance direction.

15. The image forming apparatus according to claim 11, wherein the offset value is set based on a grammage of the sheet.

16. The image forming apparatus according to claim 11, wherein the control portion is configured to execute an adjustment mode in which the offset value is capable of being updated based on the first and second detection positions detected by the detection portion.

17. The image forming apparatus according to claim 16, wherein in the adjustment mode, the control portion does not cause the moving portion to move in the width direction before the sheet is inverted by the re-conveyance portion.

* * * * *